US008567510B2

(12) United States Patent
Christie et al.

(10) Patent No.: US 8,567,510 B2
(45) Date of Patent: Oct. 29, 2013

(54) PRESSURE ACTUABLE DOWNHOLE TOOL AND A METHOD FOR ACTUATING THE SAME

(75) Inventors: Stewart Christie, Aberdeen (GB); Niall Lipp, Kirkton of Skene (GB)

(73) Assignee: Petrowell Limited, Aberdeen (GB)

( * ) Notice: Subject to any disclaimer, the term of this patent is extended or adjusted under 35 U.S.C. 154(b) by 298 days.

(21) Appl. No.: 12/811,108

(22) PCT Filed: Feb. 19, 2009

(86) PCT No.: PCT/GB2009/050162

§ 371 (c)(1),
(2), (4) Date: Aug. 13, 2010

(87) PCT Pub. No.: WO2009/106875

PCT Pub. Date: Sep. 3, 2009

(65) Prior Publication Data

US 2010/0300703 A1 Dec. 2, 2010

(30) Foreign Application Priority Data

Feb. 27, 2008 (GB) ..... 0803527.1

(51) Int. Cl.
*E21B 34/10* (2006.01)

(52) U.S. Cl.
USPC ..... 166/375; 166/122; 166/179

(58) Field of Classification Search
USPC ..... 166/122, 179, 375
See application file for complete search history.

(56) References Cited

U.S. PATENT DOCUMENTS

| | | | | |
|---|---|---|---|---|
| 4,108,257 | A | 8/1978 | Sizer | |
| 4,361,188 | A | 11/1982 | Russell | |
| 4,436,149 | A | 3/1984 | Edwards | |
| 4,834,175 | A * | 5/1989 | Ross et al. | 166/120 |
| 5,947,205 | A | 9/1999 | Shy | |
| 6,244,351 | B1 | 6/2001 | Patel et al. | |

FOREIGN PATENT DOCUMENTS

GB 2093094 A 8/1982

OTHER PUBLICATIONS

Manolache, Iustin, "International Search Report", for PCT/GB2009/050162 as mailed Sep. 23, 2009, 5 pages.

* cited by examiner

*Primary Examiner* — Yong-Suk Ro
(74) *Attorney, Agent, or Firm* — Winstead PC

(57) ABSTRACT

Pressure actuable downhole tool such as a packer and a method for actuating the same typically uses a control line to trigger a configuration change in the tool in which a communication line is opened between the throughbore of the tool and apressure responsive actuator, allowing the pressure responsive actuator to be set by downhole fluid pressure applied via the throughbore. Thus the pressure from the control line is used to trigger actuation of the tool, but the throughbore pressure is used to set the tool. The advantage of this activation mechanism is that the tool can be set even when pressure supplied by the control line is insufficient to fully actuate or set the tool, and in certain embodiments, the tool can be set using much higher tubing pressure than could be supplied through the control line, thereby allowing more reliable and instantaneous setting than tools set using control line pressure alone.

17 Claims, 16 Drawing Sheets

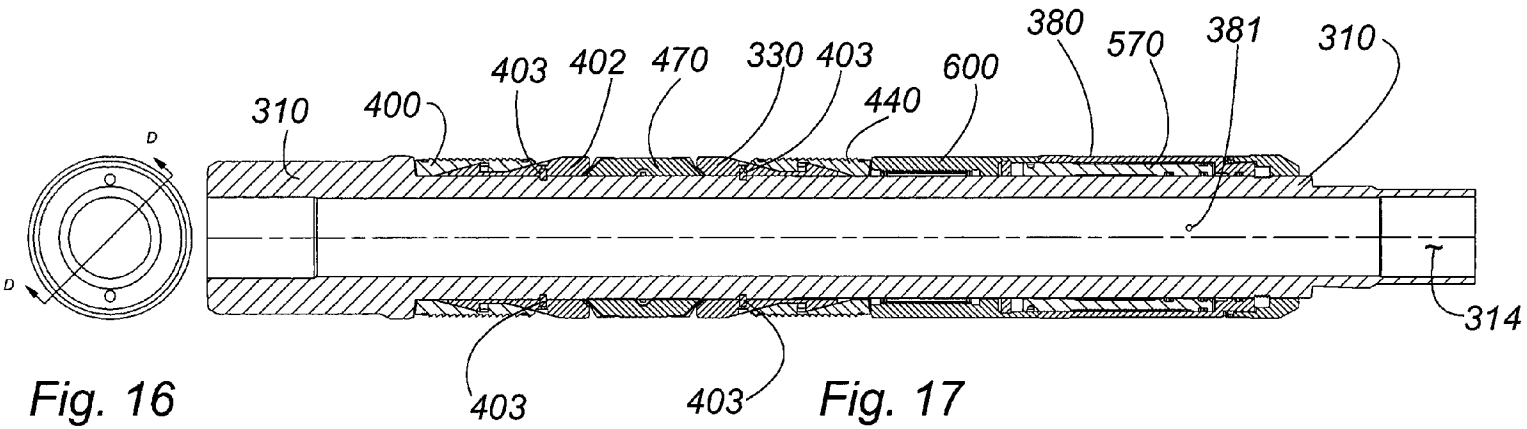
Fig. 16
Fig. 17
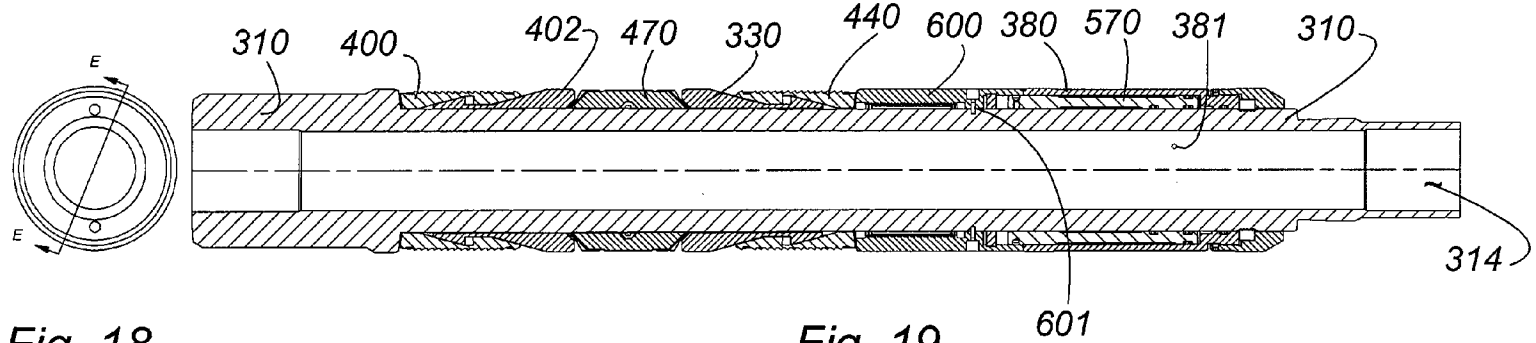
Fig. 18
Fig. 19

PRESSURE ACTUABLE DOWNHOLE TOOL AND A METHOD FOR ACTUATING THE SAME

The present invention relates to a pressure actuable downhole tool and a method for actuating a downhole tool.

There are two common conventional methods of setting downhole tools using pressure: the tubing method and the control line method.

The tubing method for setting downhole tools is achieved by exposing an actuator within the tool to fluid pressure from the downhole tubing. When an operator wishes to set the tool, a plugging device such as a bridge plug is placed in the throughbore of the tubing below the downhole tool to be actuated. The fluid in the tubing above the bridge plug is then pressurised so that the increased fluid pressure is communicated to the actuator thereby to set the tool. This is a quick and reliable method of actuating a downhole tool. However, the tubing method for setting downhole tools is indiscriminate. Use of this method can be undesirable when a tubing string incorporates several tools that are pressure actuated. Furthermore, the arrangement whereby the actuator is constantly exposed to tubing pressure can result in premature actuation of the tool when there are inadvertent increases in tubing pressure.

The control line method of actuating a downhole tool involves communicating with an actuator within the tool via a control line from surface. Thus, pressurised fluid can be selectively deployed down the control line to expose the actuator to a predetermined minimum pressure and set the tool. Although this method removes the risk of accidental actuation of the tool, the amount of pressurised fluid that can be supplied is limited by the volume of fluid carried in a typically narrow bore control line located in or strapped against the wall of the tubing string. Therefore, setting of the tool can take far longer to achieve since there is an inevitable delay until the pressurised fluid accumulates in sufficient quantity to actuate the tool.

According to a first aspect of the invention, there is provided a pressure actuable downhole tool, the tool comprising:

- a pressure responsive actuator arranged to actuate the downhole tool on exposure to a predetermined minimum pressure;
- a communication line capable of transmitting downhole fluid pressure to the pressure responsive actuator; and
- a trigger adapted to change the configuration of the tool between a first configuration in which the communication line is substantially fluidly isolated and a second configuration which permits fluid communication along the communication line to activate the pressure responsive actuator.

According to a second aspect of the invention, there is provided a method of actuating a downhole tool, wherein the method comprises:

(a) providing a pressure responsive actuator, a communication line capable of communicating downhole pressure to the pressure responsive actuator, and a trigger adapted to change the configuration of the tool between a first configuration in which the communication line is substantially fluidly isolated and a second configuration which permits fluid communication along the communication line to activate the pressure responsive actuator;

(b) substantially fluidly isolating the communication line in the first configuration;

(c) running the tool downhole;

(d) actuating the trigger to change the configuration of the tool into the second configuration, and thereby allowing downhole fluid pressure to activate the pressure responsive actuator via the communication line; and (e) actuating the downhole tool.

The pressure actuable downhole tool can comprise a throughbore and the communication line can be capable of transmitting downhole fluid pressure from the throughbore to the pressure responsive actuator. Prior to step (d), the method can include the step of increasing the fluid pressure within the throughbore of the tool.

The trigger can be remotely actuable. The trigger can be actuable from surface. Alternatively, the trigger can be actuable from a downhole source.

The trigger can be selectively actuable between the first and second configurations to selectively move the pressure responsive actuator in order to actuate the downhole tool.

At least part of the tool can be provided with seals to substantially fluidly isolate the communication line in the first configuration.

At least one of the trigger and the pressure responsive actuator can be accommodated in a sidewall of the tool. Preferably both the trigger and the pressure responsive actuator are housed within a sidewall of the tool.

The pressure responsive actuator can comprise a chamber and an actuator piston sealed within the chamber and movable therein.

The communication line can extend between the throughbore and the chamber. The communication line can extend perpendicular to a direction of movement of the actuator piston within the chamber.

The actuator piston can be provided with two seal assemblies, spaced from one another along the piston to seal the actuator piston within the chamber. In the first configuration, the seal assemblies can be located on either side of the communication line within the chamber to substantially fluidly isolate the communication line.

The trigger can be actuable to initiate movement of the actuator piston within the chamber. The trigger can be actuable to move the actuator piston from the first to the second configuration by moving the actuator piston by a predetermined length such that both of the seal assemblies locate on one side of the communication line.

The trigger can comprise a control line or fluid line having an opening in the chamber. The fluid line can selectively deliver a supply of hydraulic fluid into the chamber to move the actuator piston sealed therein. The fluid line can be connected to a supply of hydraulic fluid from a remote source. The remote source can be a surface source or a downhole source such as a pump or a reservoir.

The opening of the fluid line within the chamber can be spaced from the communication line.

The trigger can also include a trigger piston sealed in the chamber. The trigger piston can be shorter in length than the actuator piston.

The trigger piston can be sealed in the chamber between the opening of the fluid line and the communication line. The chamber can be provided with a trigger piston stop to restrain movement of the trigger piston within an area of the chamber defined between the communication line and the opening for the fluid line. The trigger piston can be movable by controlling the supply of hydraulic fluid through the opening.

The trigger piston can act on the actuator piston to move the actuator piston between the first and the second configurations.

The pressure actuable tool can be a tool selected from the group consisting of: packers; inflatable elements; gripping tools; slips; valves; sliding sleeves; and other flow control devices.

"Downhole" as used herein is intended to refer to the space within any extended conduit and includes all wellbores and boreholes such as those used in the oil and gas industry.

Embodiments of the invention will now be described with reference to the accompanying Figures in which:—

Figure 6A:
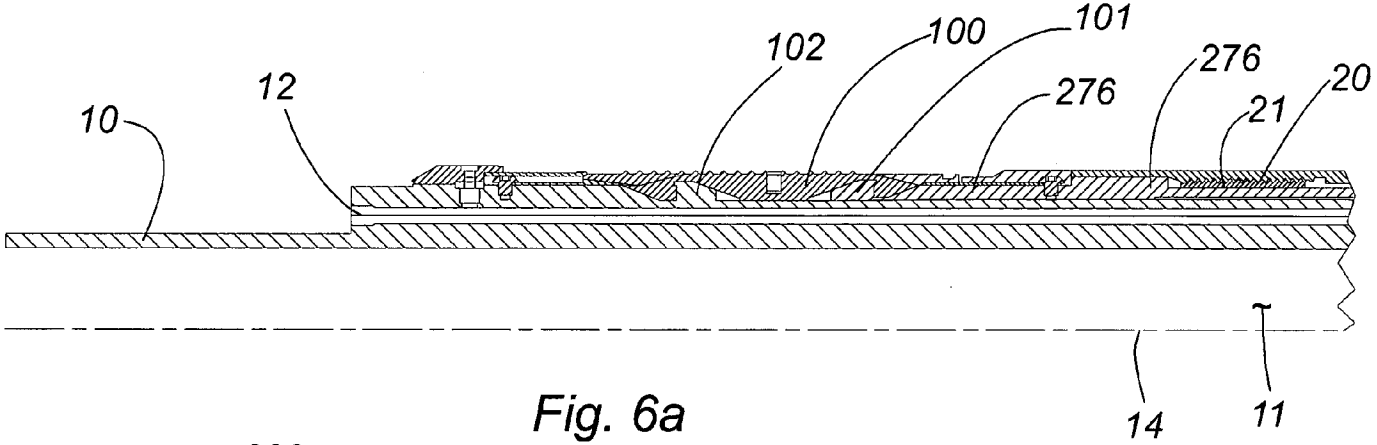
Figure 6B:
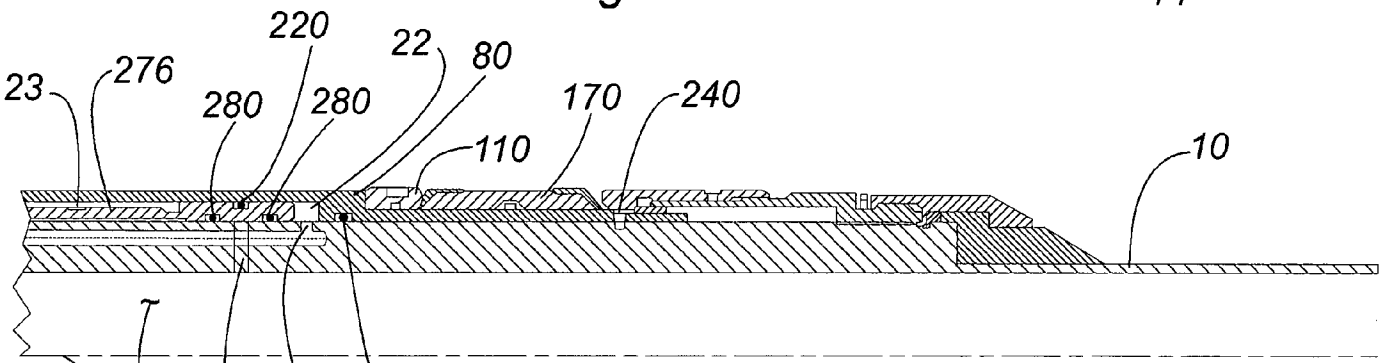
Figure 7A:
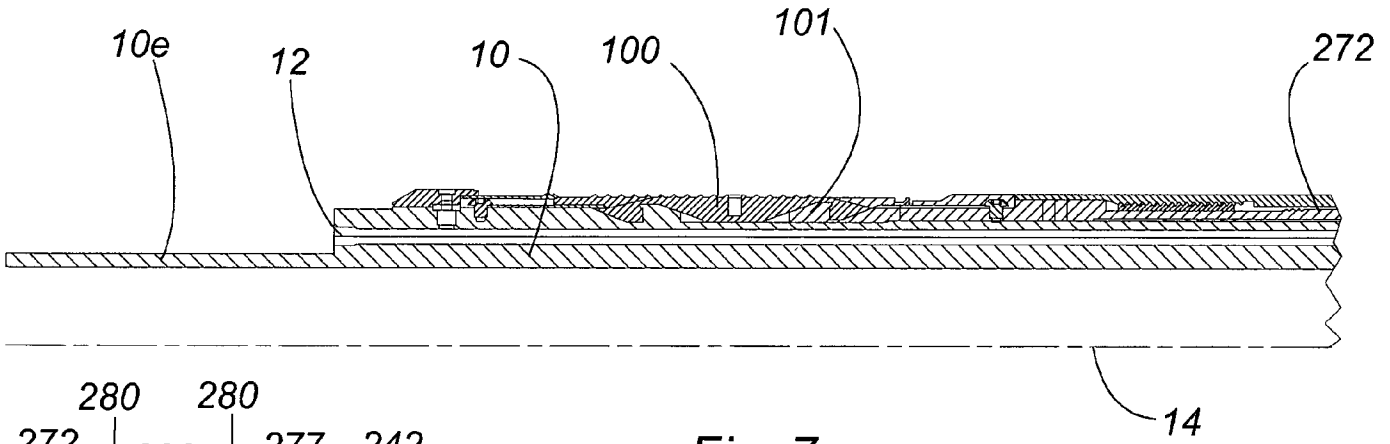
Figure 7B:
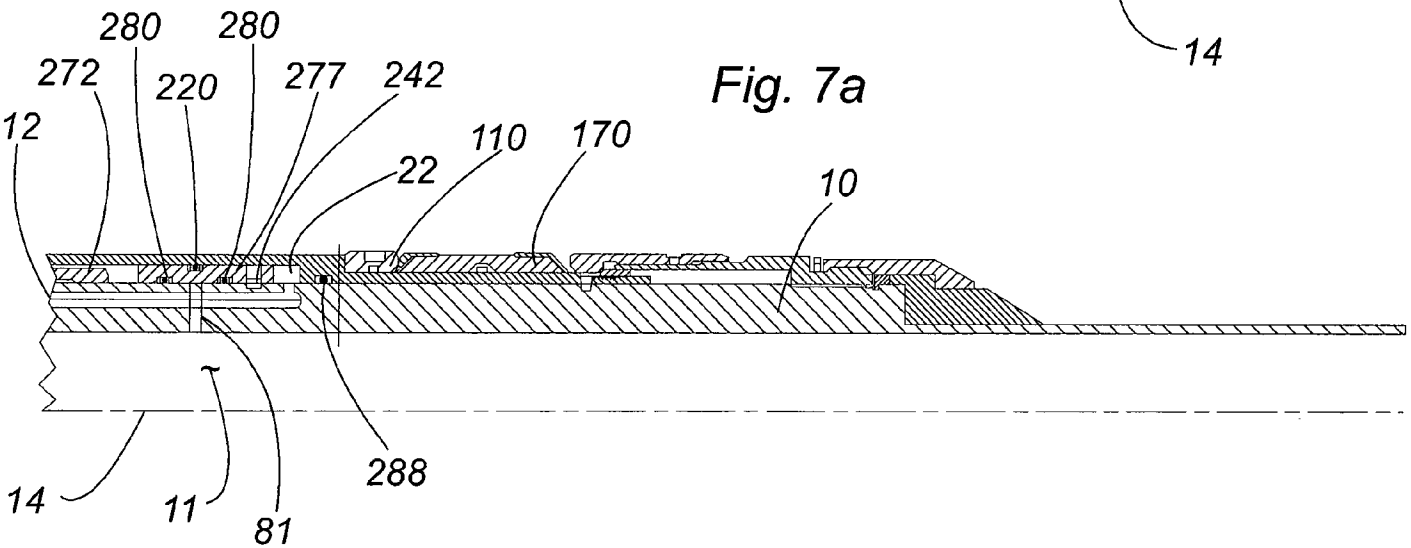
Figure 8A:
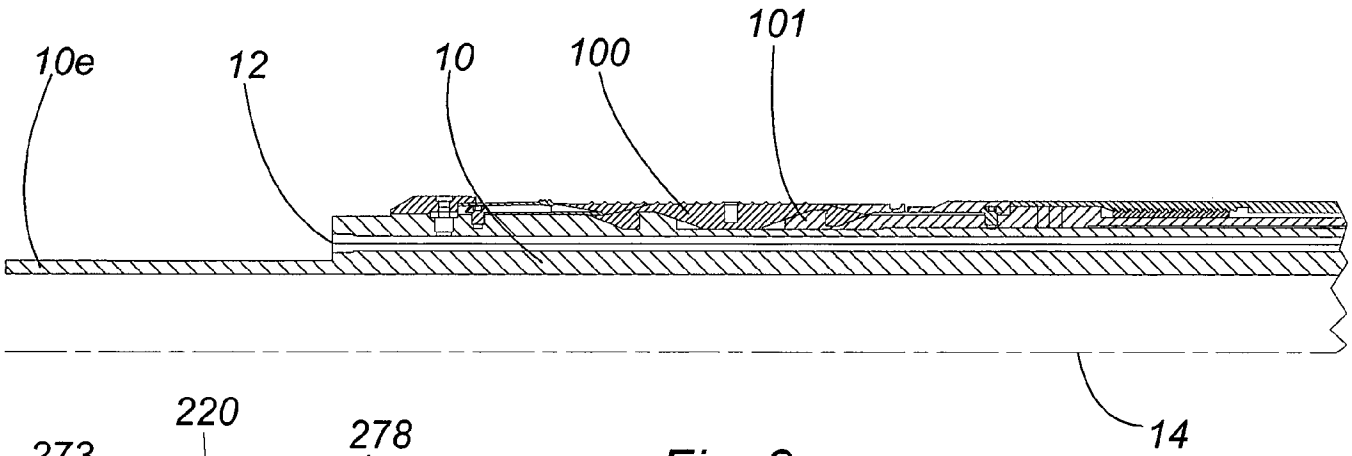
Figure 8B:
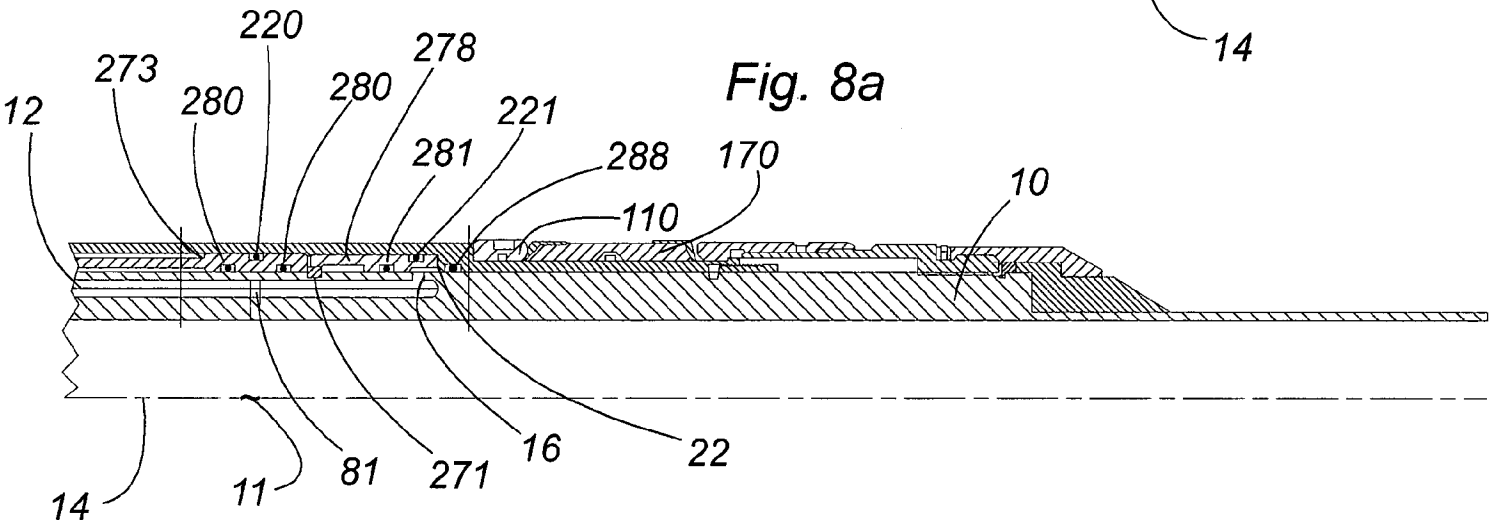
Figure 9A:
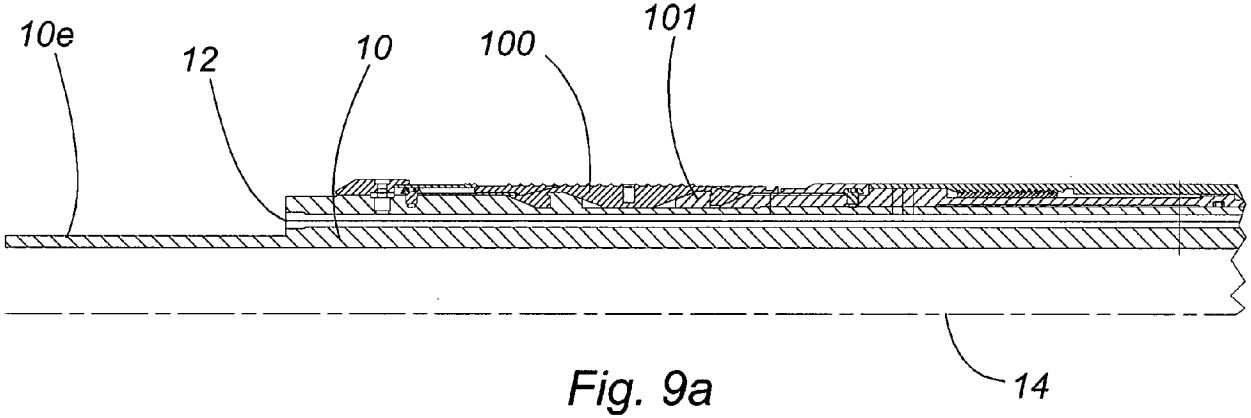
Figure 9B:
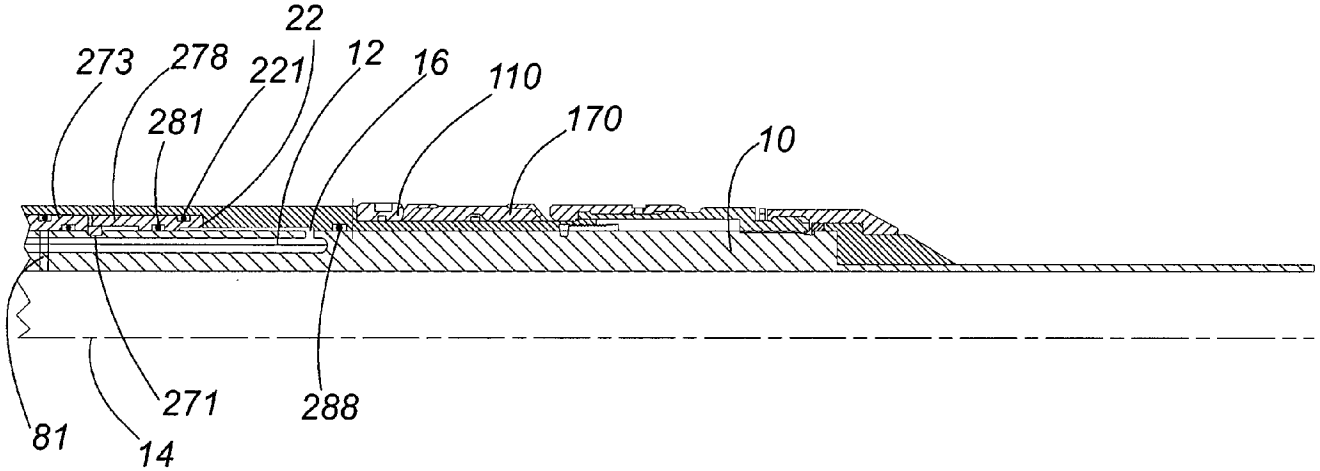
Figure 10:
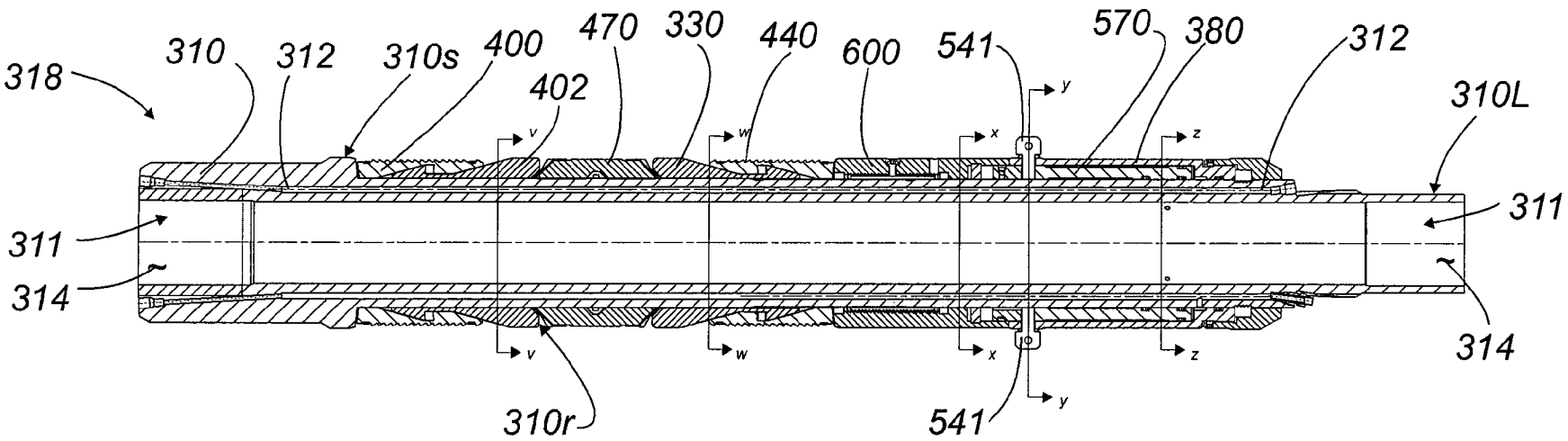
Figures 11A, 11B, 11C, 11D, 11E:
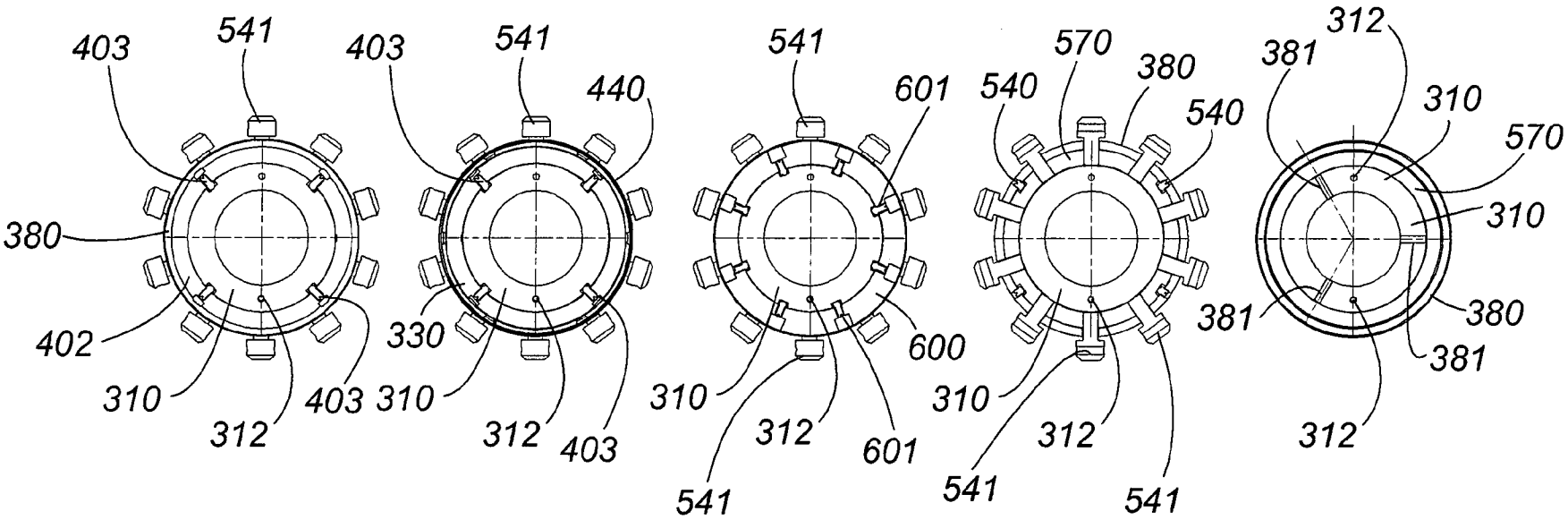
Figure 12:
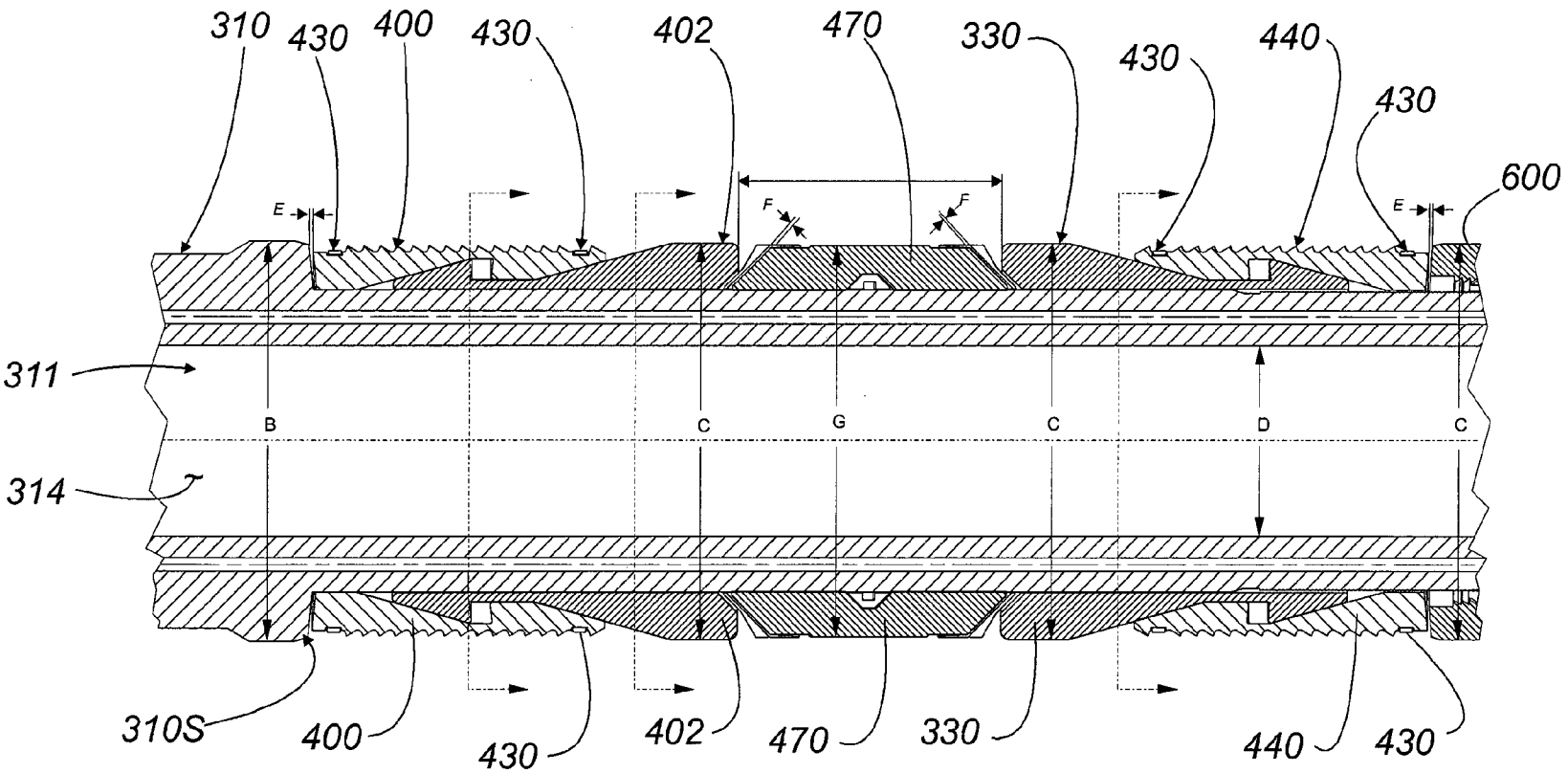
Figures 13A, 13B, 13C:
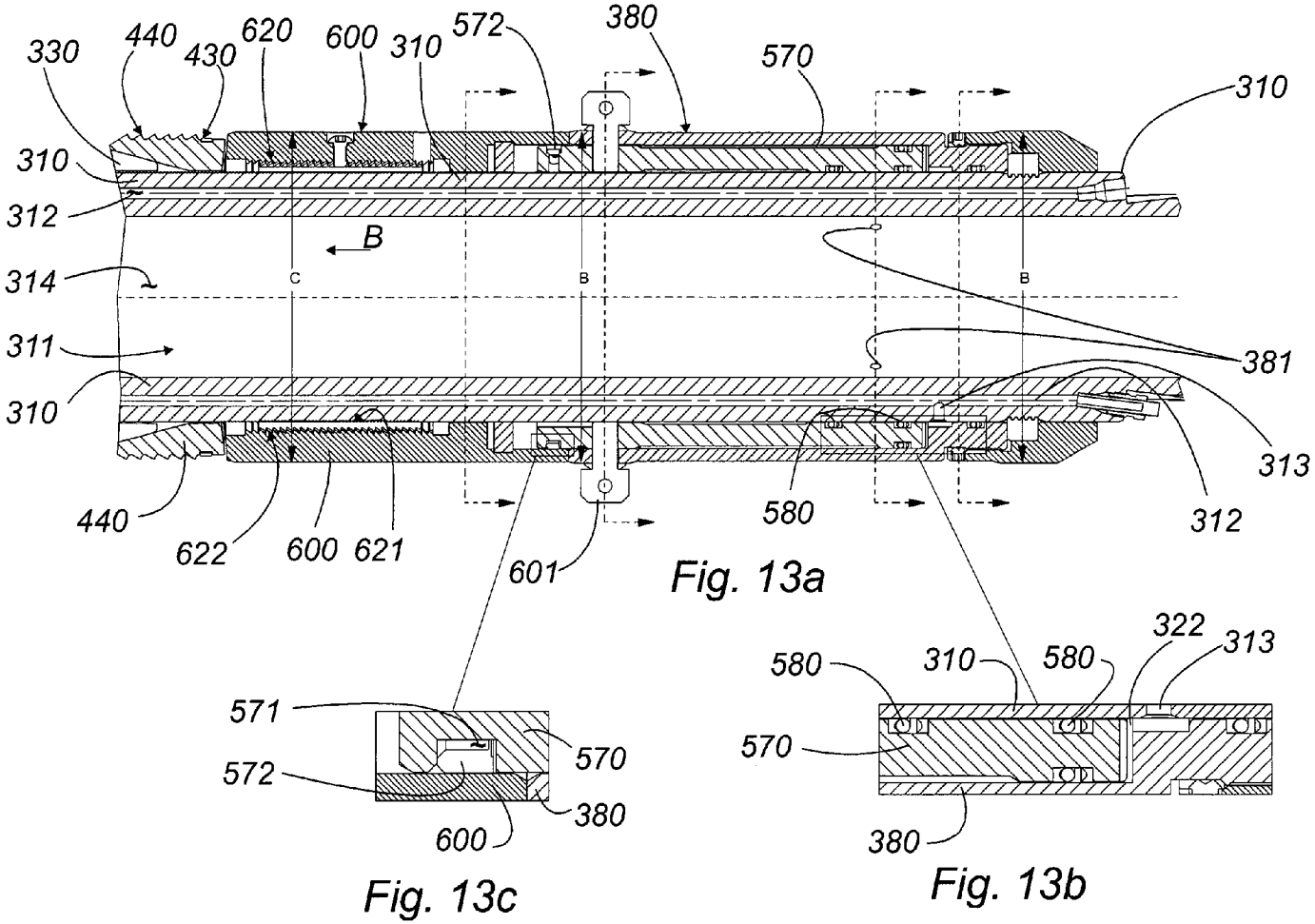

FIGS. 6*a* and 6*b* are consecutive sectional views along a top half of a second embodiment of a pressure actuable downhole tool;

FIGS. 7*a* and 7*b* are consecutive sectional views along a top half of a third embodiment of a pressure actuable downhole tool;

FIGS. 8*a* and 8*b* are consecutive sectional views along a top half of a fourth embodiment of a pressure actuable downhole tool;

FIGS. 9*a* and 9*b* are consecutive sectional views along a top half of a fifth embodiment of a pressure actuable downhole tool;

FIG. 10 shows a sectional view along a sixth embodiment of a pressure actuable downhole tool;

FIGS. 11*a-e* show cross sectional views along FIG. 10 at various locations;

FIGS. 12 and 13*a* show consecutive sectional views along a respective top and bottom portion of FIG. 10;

FIGS. 13*b* and 13*c* show detailed views of parts of FIG. 13*a;*

Figure 14:
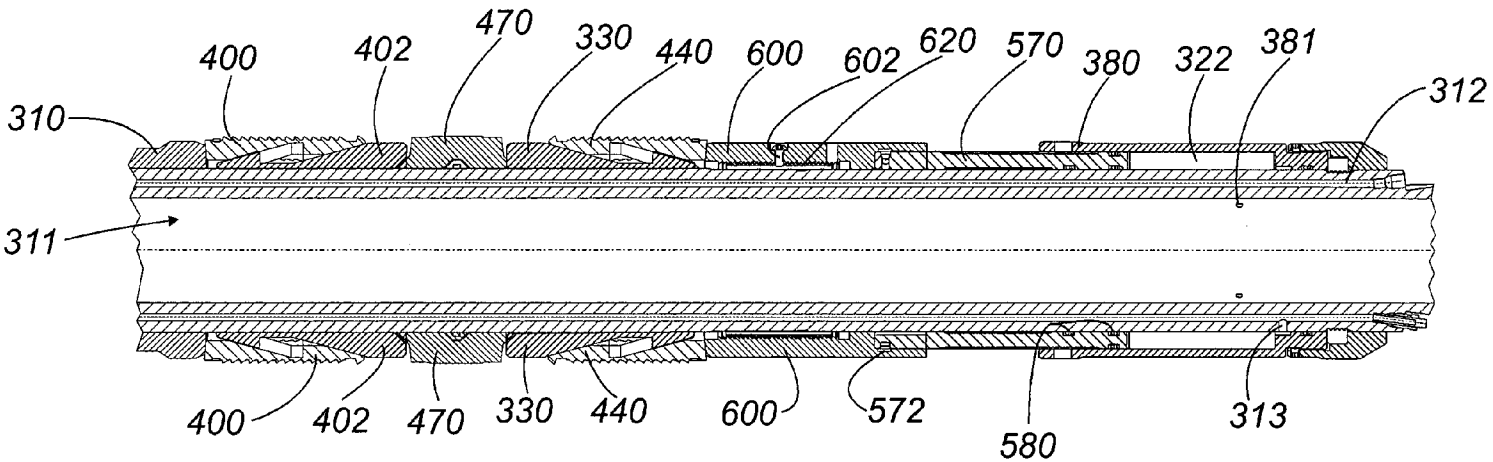
Figure 15:
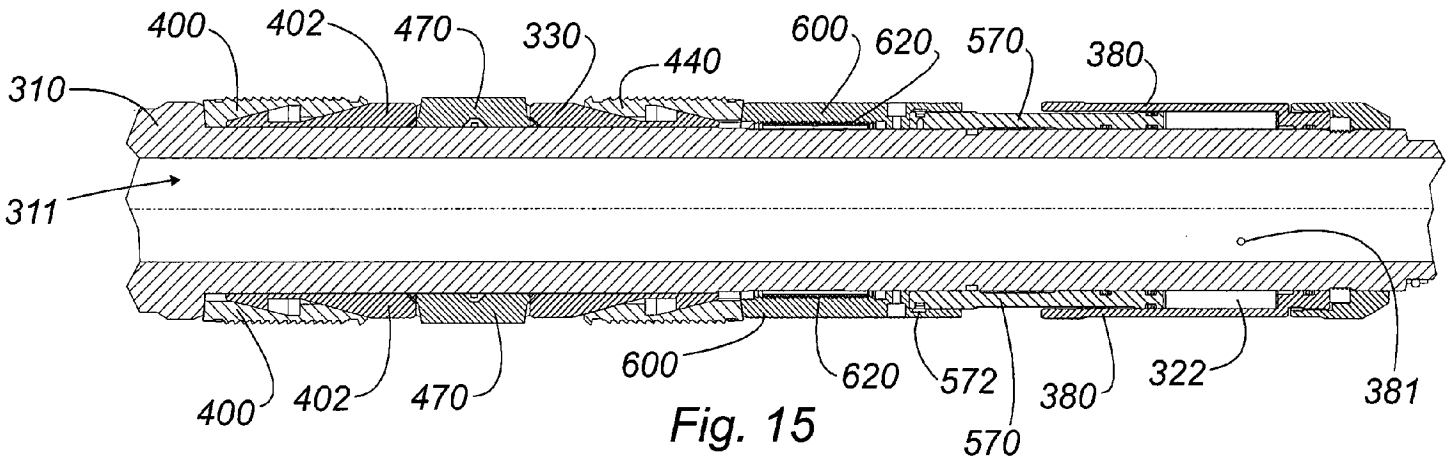
Figure 21:
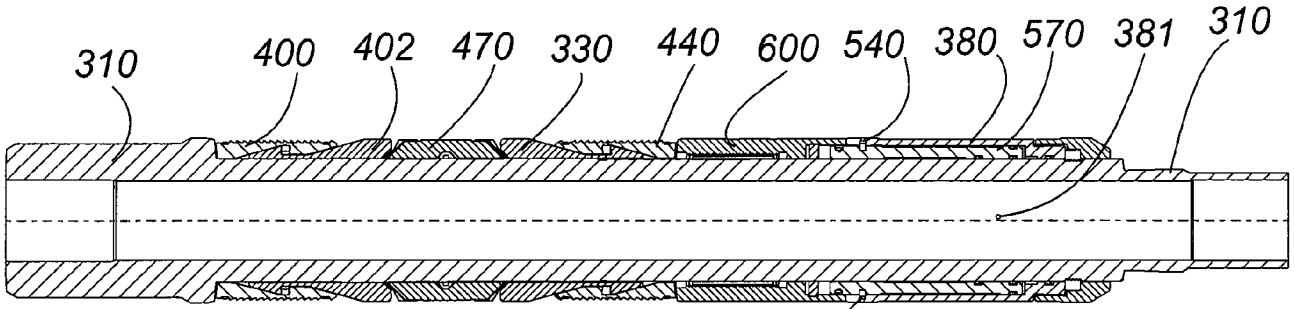
Figure 20:
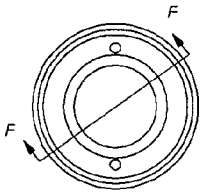
Figure 22:
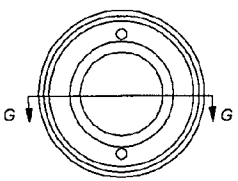

FIG. 14 shows a sectional view of the FIG. 10 apparatus set in wide gauge tubing;

FIG. 15 shows a sectional view of the FIG. 10 apparatus set in narrow gauge tubing, and viewed in a different plane than FIG. 14;

FIG. 16 shows a cross sectional view of the FIG. 10 tubing;

FIG. 17 shows a sectional view through line D-D of FIG. 16;

FIG. 18 shows a cross sectional view of the FIG. 10 tubing;

FIG. 19 shows a sectional view through line E-E of FIG. 18;

FIG. 20 shows a cross sectional view of the FIG. 10 tubing;

FIG. 21 shows a sectional view through line F-F of FIG. 20;

FIG. 22 shows a cross sectional view of the FIG. 10 tubing; and

Figure 1:
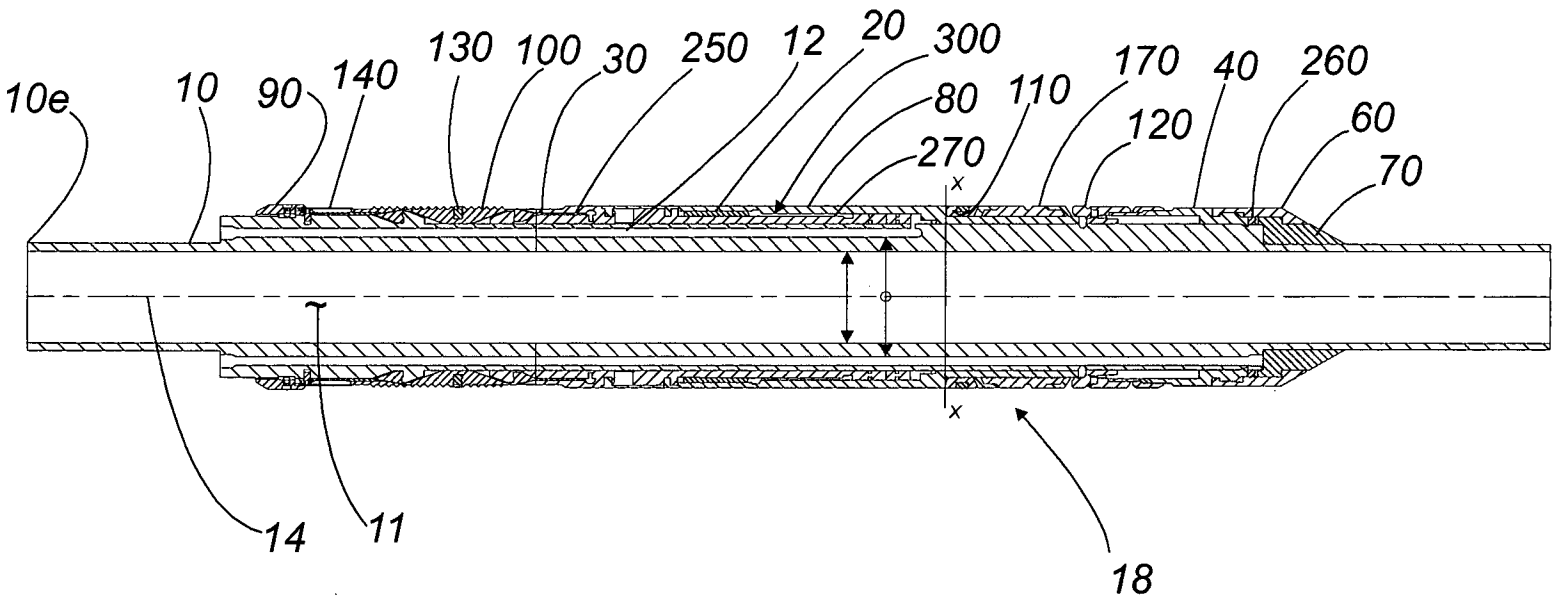
FIG. 1 is a sectional view along a first embodiment of a pressure actuable downhole tool.
Figure 2:
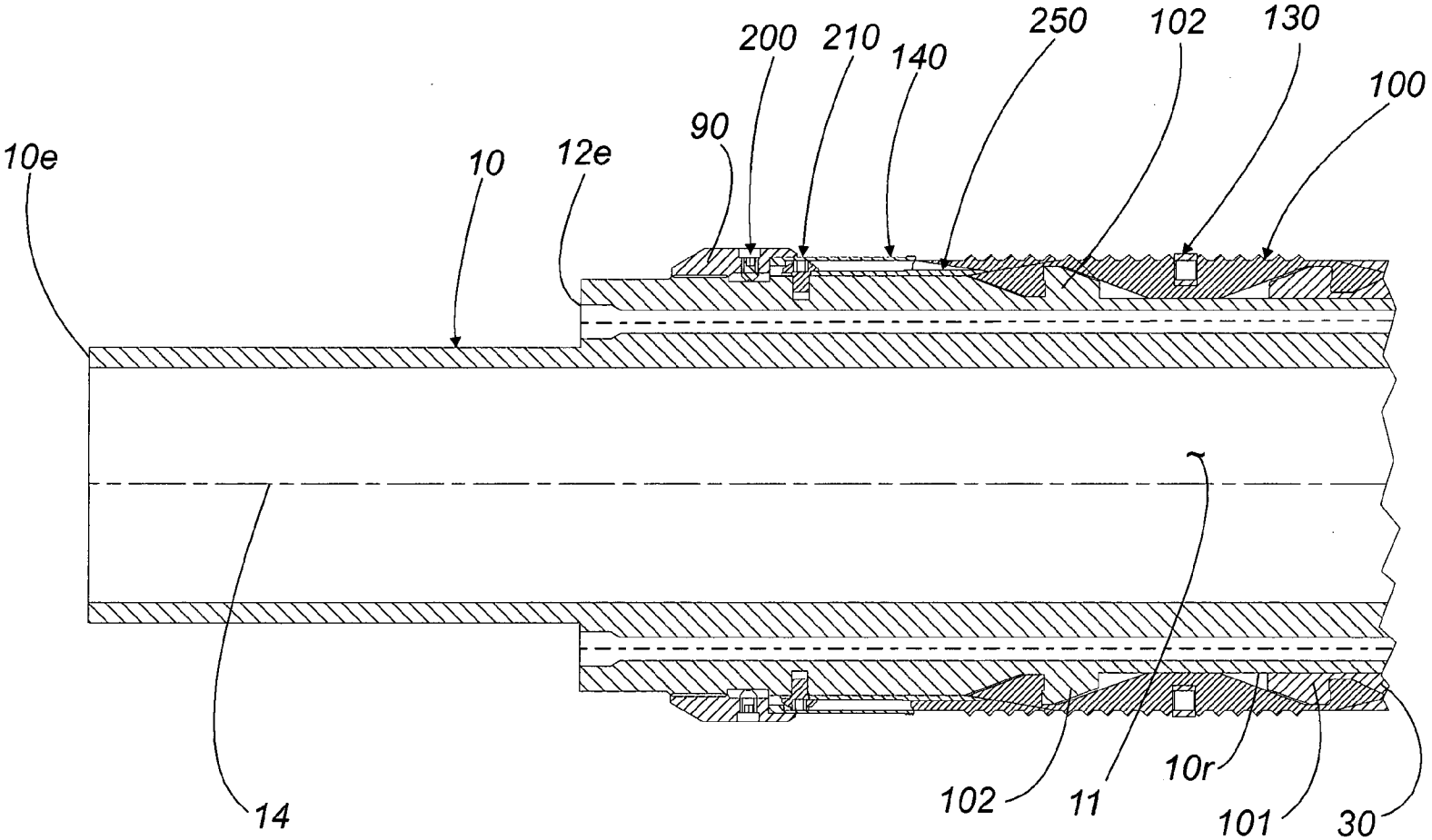
FIGS. 2 to 4 are detailed sectional views along the tool of FIG. 1 showing the left hand portion, middle portion and right hand portion, respectively.
Figure 3:
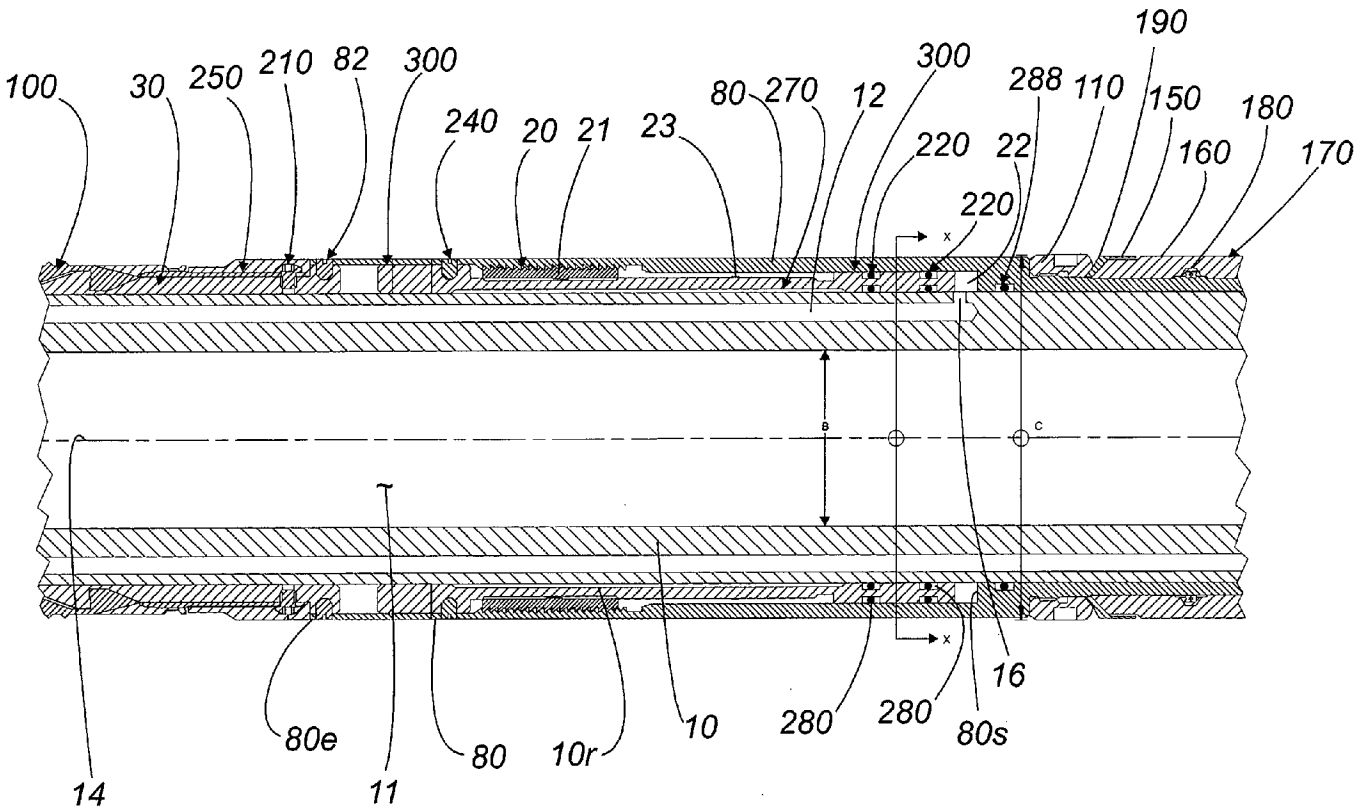
Figure 4:
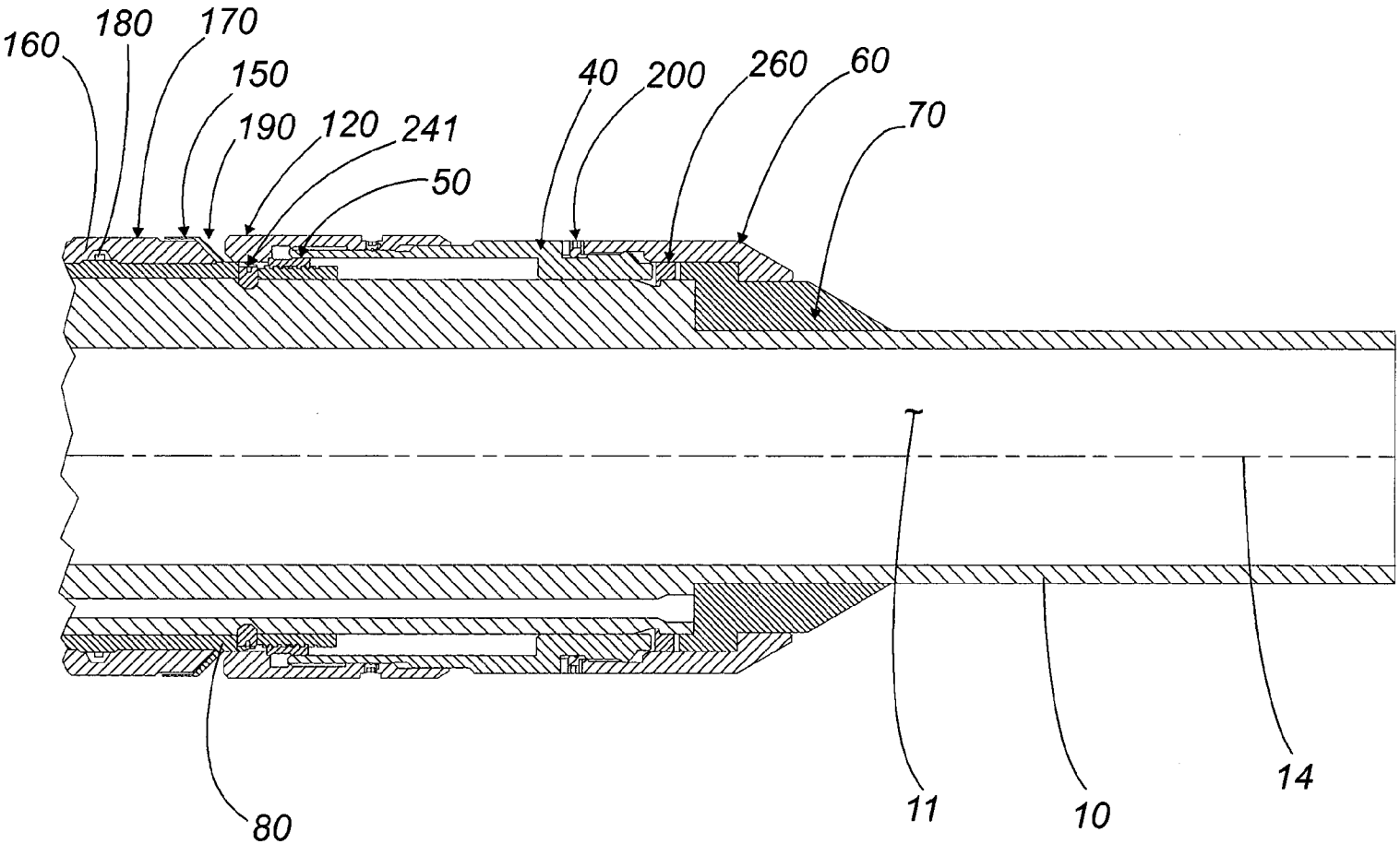
Figure 23:
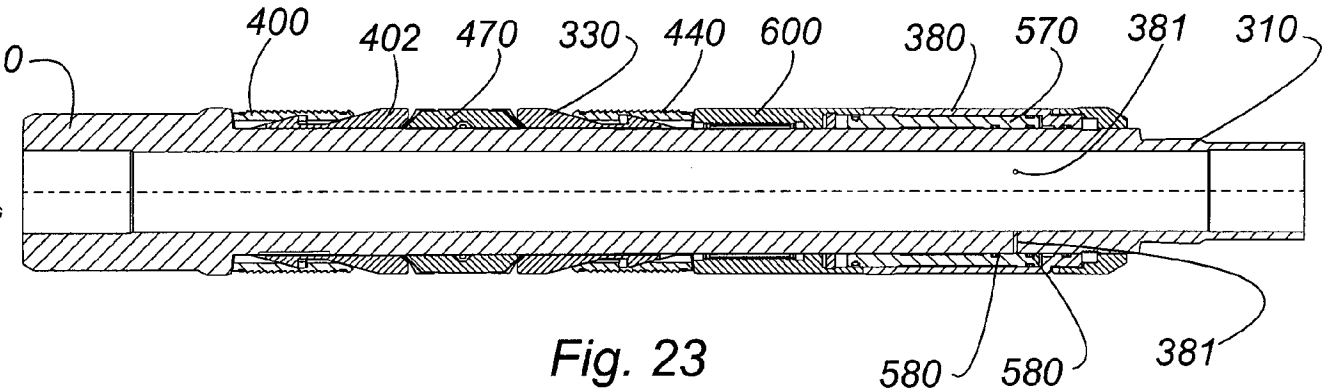

FIG. 23 shows a sectional view through line G-G of FIG. 20;

A pressure actuable downhole tool is shown generally at 18 in FIG. 1. The downhole tool 18 of the present embodiment is a packer 18. The packer 18 has a substantially cylindrical tubular body 10 having a throughbore 11 and a longitudinal axis 14. The ends of the body 10 are typically arranged to be attached to adjacent lengths of tubing in use so that the tool 18 can form part of a downhole tubing string (not shown). FIGS. 2 to 4 show consecutive detailed sectional views of the tool 18.

The drawings depict the embodiments from left to right, with the left hand end of the figures being positioned closest to the surface. The upper end 10*e* of the body 10 shown at the left hand side of FIG. 2 is therefore positioned closest to the surface in use. A control line 12 extends through a sidewall of the body 10 parallel to the longitudinal axis 14. When the end 10*e* is coupled to an adjacent length of tubing in a tubing string, an end 12*e* of the control line 12 is in fluid communication with a hydraulic fluid control line running through the adjacent pipe length, either from surface or an alternative downhole source.

An exterior of the body 10 is provided with an annular ramp 102 that is wedge-shaped in section, with the tapered end of the ramp 102 leading to an annular recess 10*r* that accommodates an activation mechanism denoted generally at 300. Slips 100 having external serrated gripping ribs are retained on the exterior of the body 10 by two slip springs 250, attached by button head cap screws 210 at the upper end to the body 10 and at the lower end to a lower cone 30. At the upper end, a debris ring 140 surrounds the button head cap screw 210 and the slip spring 250 to substantially restrict ingress of dirt. A slip retainer 90 is fixed to an exterior of the body 10 using a set screw 200 and the slip retainer 90 overlays the debris ring 140 to substantially restrict axial movement of the slips 100 during activation thereof.

An upper end of the lower cone 30 has an annular ramp 101 that is wedge-shaped in section and the tapered portion of the annular ramp 101 faces the tapered portion of the annular ramp 102. An inner surface of the slips 100 is ramped and corresponds to the slope of the annular ramps 101, 102 such that movement of the annular ramps 101, 102 towards one another drives the slips 100 up the ramps 101, 102 and radially outwardly. A slip ring 130 extends around the slips 100 and retains the slips 100 in the positions shown in FIGS. 1 and 2 in order to ensure that the slips 100 do not inadvertently move radially outwardly and the outer profile of the tool 80 does not catch or snag as it is run downhole before use.

A generally cylindrical hollow piston housing 80 (shown in FIGS. 3 and 4) extends co-axially with the body 10 and has an inner diameter greater than the outer diameter of the body 10. The piston housing 80 is retained at its upper end 80*e* to the lower cone 30 by a shear screw 82. The piston housing 80 has an inwardly extending annular step 80*s* thereby defining an annular space bordered by the annular step 80*s*, an interior of the piston housing 80, a lower end of the lower cone 30 and the exterior of the body 10. An annular piston 270 is housed within this annular space. The piston 270 is temporarily attached to the piston housing 80 by a shear screw 240. The shear screw 240 enables the piston 270 to be retained in the position shown in FIG. 3 while the tool 80 is run downhole prior to actuation. An annular piston lock ring 20 is threadedly engaged with an inner surface of the piston housing 80 and extends radially inwardly towards the piston 270. The piston lock ring 20 has an annular protrusion 21 and the piston 270 has a co-operable portion 23 that engages with the annular protrusion 21 when the protrusion and the co-operable portion 23 are aligned, thereby to retain the annular piston 270 and the lock ring 20 in secure engagement following actuation of the tool 18.

Figure 5:
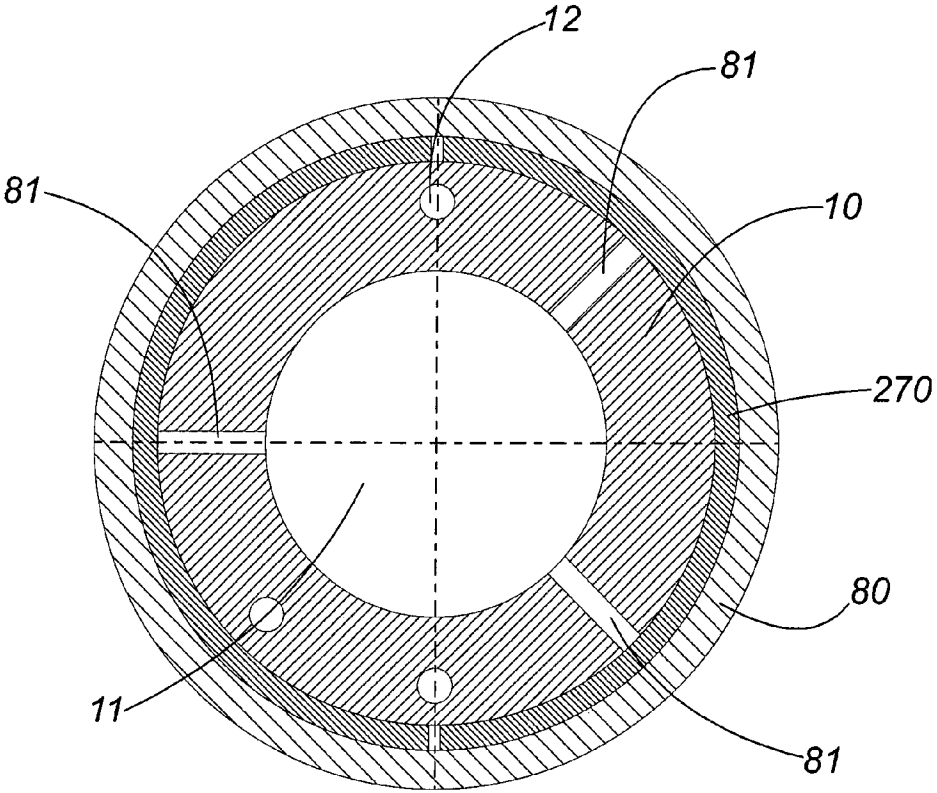
FIG. 5 is a sectional view along the line X-X shown in FIG. 3.

FIG. 3 shows the location of section X-X in FIG. 5. The body 10 has three equidistant radial channels 81 surrounding the throughbore 11 that extend through the body 10 from the throughbore 11 as shown in FIG. 5. The radial channels 81 are radially offset from the control line 12 and are therefore not visible in the section along the tool 18 shown in FIG. 3. The piston 270 surrounds the radial channels 81 and thereby obturates the outer ends of the channels 81 in a first configuration prior to actuation of the tool 18.

A lower end of the piston 270 is sealed against the piston housing 80 by axially spaced outer O-ring seals 220 located in annular grooves in the outer surface of the piston 270. The lower end of the piston 270 is also sealed against the body 10 on either side of the radial channels 81 by inner O-ring seals 280 located in annular grooves within the piston 270.

Below the annular step 80*s*, the piston housing 80 is sealed against the body 10 by an O-ring seal 288 located in an annular groove on the interior of the piston housing 80. Each annular groove in the piston 270 and the piston housing 80 that accommodates the O-rings 220, 280, 288 is optionally provided with back-ups (not shown) for the seals 220, 280, 288 to support the rubber seals 220, 280, 288 and close any annular extrusion gaps thereby to restrict rubber extrusion of the seals 220, 280, 288.

The 12 extending through the body 10 has a radially extending passageway leading to an opening 16 such that the control line 12 is in fluid communication with a chamber 22 defined between an end of the piston 270, part of the interior of the piston housing 80 and the annular step 80*s*.

An upper gauge ring 110 and a lower gauge ring 120 are each attached to back-up shoes 190 and a packing element back-up ring 150 located on an exterior of the piston housing 80. A packing element 170 is retained between the packing element back-up rings 150. The packing element 170 incorporates a centrally disposed element filler ring 160 sealed against an exterior of the piston housing 80 by an O-ring seal 180. Towards its lower end, the piston housing 80 is coupled to the body 10 by a shear screw 241. A release housing 40 is partially overlaid by the lower gauge ring 120 and the release housing 40 holds a retaining ring 50 in engagement with an external lower part of the piston housing 80. The release housing 40 has a shear ring retainer 60 attached thereto by means of a set screw 200. The shear ring retainer 60 allows a shear ring 260 to be retained between the release housing 40 and a stop ring 70 located towards the lower end 10*e* of the body 10. The shear ring 260 of the present embodiment can withstand a shear force of 70 000 lbs (31751 kilograms).

Prior to use, the tool 18 is attached at its upper and lower ends 10*e* to adjacent lengths of pipe to incorporate the tool 18 into a tool string (not shown). At its upper end 10*e* the body 10 is connected to the adjacent pipe such that the control line 12 is in fluid communication with a controlled supply of fluid either from surface or a downhole source.

The tool string carrying the tool 18 is then run into a cased wellbore (not shown) thereby creating an annulus (not shown) between an exterior of the tool string and the casing that lines the borehole. The tool is run-in in a first or pre-actuation configuration shown in FIGS. 1 to 4, with the radial channels 81 (FIG. 5) substantially fluidly isolated by the O-ring seals 280. Once the tool 18 is situated in the wellbore, increases in pressure within the throughbore 11 of the tubing string will not cause actuation of the tool 18 because the radial channels 81 are substantially obturated by the piston 270 that has seals 280 on either side of the radial channels 81. The seals 280 substantially restrict communication between the pressurised fluid in the throughbore 11 and the annular space surrounding the body 10. As a result, pressure in the throughbore 11 of the tubing string has no effect on the piston 270.

When an operator wishes to actuate the tool 18, a plugging device such as a bridge plug (not shown) is typically located in the tubing upstream of the tool 18 (i.e. vertically below the tool 18). The plugging device makes a seal across the throughbore 11 of the tubing string. The fluid in the throughbore 11 of the tubing string is then pressured up to increase the pressure differential between the throughbore 11 of the tubing string and the exterior of the tool 18. The operator then delivers a controlled supply of hydraulic fluid via the control line 12 from surface or a separate downhole source. The hydraulic fluid travels along the control line 12 and through the opening 16 into the chamber 22. The fluid pressure within the chamber 22 acts on the annular step 80*s* of the piston housing 80 between the seals 288 and 220. The fluid pressure within the chamber 22 also acts on the lower end of the piston 270 between the seals 220 and 280. The net effect of the increased pressure in the chamber 22 acting on the piston housing 80 and the piston 270 in opposing directions causes the shear screw 240 attaching the piston 270 to the piston housing 80 to shear, thereby allowing movement of the piston 270 in an upwards direction.

Once the piston 270 has moved a short distance (in an upwards direction) such that the inner O-ring seal 280 moves beyond the sectional line X-X in FIG. 3, the radial channels 81 will then be in communication with the chamber 22. As a result, pressurised fluid from the throughbore 11 floods the chamber 22 and drives the piston 270 towards the lower cone 30. This has the immediate effect of shearing the shear screw 82 attaching the lower cone 30 to the piston housing 80. At this point tubing pressure from the throughbore 11 acts upon the piston 270 to drive the lower cone 30 in an upwards direction. Thus, the annular ramp 101 of the lower cone 30 is driven towards the annular ramp 102 located on an exterior of the body 10. Convergent movement of the annular ramps 101, 102 drives the underside of the slips 100 outwardly since their axial movement is restricted. The retaining ring 130 is broken and the external serrated gripping ribs of the slips 100 move radially until the ribs engage with the casing to mechanically secure the tool 18 to the casing.

Simultaneously, once the tubing pressure from the throughbore 11 floods the chamber 22, the piston housing 80 is urged downwardly as the tubing pressure is acting on the annular step 80*s* between the seals 220, 288. Shearing of the shear screw 82 attaching the piston housing 80 to the lower cone 30 as well shearing of the shear screw 241 attaching the piston housing 80 to the body 10 allows axial movement of the piston housing 80 relative to the body 10. This enables the packing element 170 to expand and fill the annulus between the tool 18 and the casing to create a reliable seal across the annulus and thereby to isolate the annulus.

The annular protrusion 21 of the piston lock ring 20 engages with the co-operable portion 23 on the piston 270 such that following a degree of relative movement of the piston housing 80 and the annular piston 270, the two components are locked together preventing any return.

According to the above described method for activation of the tool 18, the pressure from the controlled source supplied via the control line 12 is used to trigger actuation of the tool 18. However, the tubing pressure is used to set the tool 18. The advantage of this activation mechanism is that the tool 18 can be set even when pressure supplied by the control line is insufficient to fully actuate or set the tool 18. Additionally, the embodiment has the advantage that the slips 100 and the packing element 170 are set using tubing pressure, which is generally more reliable and instantaneous than tools 18 set using control line pressure alone. Furthermore, the fact that the tubing pressure is not constantly acting on the internal actuation mechanism of the tool 18 has the advantage that fluctuations in tubing pressure prior to actuation will have no effect on the tool 18 until the operator desires that the tool 18 is ready to be set and thereby triggers the process using control line fluid pressure via the cylindrical bore 12.

Provision of the separate spaced piston 270 and lower cone 30 is advantageous since the spaced lower cone 30 removes the initial load from the piston 270. Therefore the gap between the piston 270 and the lower cone 30 allows the control line pressure delivered via the control line 12 to simply act as a trigger initially moved by the control line pressure. The setting of the tool 18 is solely achieved when the tubing pressure floods the chamber 22 to drive the piston 270 into the lower cone 30 to complete the actuation process. This has the advantage that the tubing pressure is responsible for the full actuation and setting of the downhole tool and the control line fluid simply triggers the actuation or setting step. The use of tubing pressure to set the tool 18 allows near simultaneous (albeit partially sequential) actuation of the slips 100 and the packing element 170. This is advantageous compared with setting the tool 18 using control line pressure alone which is likely to take a greater length of time to flood the chamber 22 with pressurised fluid and drive the actuation of the tool.

A second embodiment of the invention is shown in FIGS. 6*a* and 6*b*. All like components have been given identical reference numerals. The main difference between the embodiment shown in FIGS. 6*a* and 6*b* and the previous embodiment is that no lower cone 30 is included in the tool of FIGS. 6*a* and 6*b*. The lower cone 30 is replaced by a longer length of piston 276 that is not temporarily fixed using shear screws to the piston housing 80 or the body 10. The arrangement of the inner and outer O-ring seals 220, 280 is also slightly modified, although functionally equivalent. By utilising a longer piston 276 without a break therein, the tool arrangement is simplified. The pressure from the control line via the control line 12 begins to initiate the slip 100 setting process. However, this is completed by the tubing pressure once the pressure from the throughbore 11 floods the chamber 22 and acts between the seals 220, 280 to drive the piston 276 upwardly. The remainder of the tool setting mechanism is the same as that previously described.

The advantage of the arrangement of the second embodiment is that the simplified arrangement provides a more compact internal activation mechanism and enables the overall tool length to be reduced.

A third embodiment of the invention is shown in FIGS. 7*a* and 7*b* with like reference numerals applied to like components. The embodiment shown in FIG. 7*b* differs from the first embodiment since a shorter length of annular piston 277 is provided to obturate the radial channels 81. The piston 277 is coupled to the body 10 by the shear screw 242. On exposure of the chamber 22 to control line pressure, the shear screw 242 is sheared and the trigger piston 277 is moved under the influence of the control line pressure towards a separate actuator piston 272 to initiate actuation of the slips 100 once the chamber 22 encounters pressure from the throughbore 11 via the radial channels 81.

An advantage of the third embodiment is that by reducing the length of the trigger piston 277, the volume of fluid required from the control line to move the piston 277 and trigger the actuation process is greatly reduced since the control line pressure is only required to move a short length of annular piston 277 by a short distance before the tubing pressure floods the chamber 22 to set the tool.

In all previous embodiments, the tubing pressure merges with the control line pressure in the cylindrical bore 12. This is because there are no seals to fluidly isolate the radial channels 81 and the opening 16 of the control line 12 once any of the O-ring seals 280 of the pistons 270, 276, 277 have moved axially beyond the radial channels 81 communicating the throughbore 11 with the chamber 22. A non-return valve can be provided within the tool 18, towards the surface or on a downhole pump that supplies the hydraulic fluid from a downhole source.

The fourth and fifth embodiments shown in FIGS. 8*a*, 8*b*, 9*a* and 9*b* substantially restrict merging of the pressure from the control line and the tubing pressure by isolating with seals the opening 16 from the radial channels 81.

FIGS. 8*a* and 8*b* show a fourth alternative embodiment of the invention. Again, all like components have been given identical reference numerals to those used previously. As shown in FIG. 8*b*, a trigger piston 278 is sealed in the chamber 22 by outer and inner O-ring seals 221, 281. An actuator piston 273 separate from the trigger piston 278 is sealed on either side of the radial channels 81 by inner and outer O-ring seals 220, 280 in a similar manner as previously described. A trigger piston stop 271 is fixed to an exterior of the body 10 and located between the trigger piston 278 and the actuator piston 273. When an operator wishes to actuate the tool of FIGS. 8*a* and 8*b*, pressurised fluid is supplied along the control line 12 and enters the chamber 22 via the opening 16. The trigger piston 278 is driven axially upwards until an annular step on the trigger piston 278 contacts the stop 271, which restricts further movement of the piston 278. A portion of the trigger piston 278 drives the actuator piston 273 such that the inner O-ring seals 280 are no longer located on either side of the radial channels 81 thereby allowing tubing pressure from the throughbore 11 to act on the actuator piston 273 and thus set the slips 100 of the tool 18 using tubing pressure. Once the radial channels 81 are uncovered the tubing pressure is restricted from merging with the control line pressure by the outer and inner seals 221, 281 of the trigger piston 278. Continued supply of control line fluid via the cylindrical bore 12 can act on the annular step 80*s* to set the packing element 170.

FIGS. 9*a* and 9*b* show a fifth embodiment. The fifth embodiment is similar to the embodiments shown in FIGS. 8*a* and 8*b*. The only difference is that the opening 16 from the control line 12 communicating the control line pressure to the chamber 22 is spaced further from the radial channels 81 to decrease the likelihood that the control line pressure and the tubing pressure will merge.

The fourth and fifth embodiments are advantageous since they remove a potential leak path of tubing pressure along the control line to surface. It should be appreciated that non-return valves can also be used on the control line for the forth and fifth embodiments. However, the requirement for non-return valves on the control line is obviated by the isolation of the opening 16 from the radial channels 81.

A sixth embodiment of a packer 318 is shown in FIGS. 10-23. In the sixth embodiment 318 similar features have been given the same reference numbers as in previous embodiments, but increased by 300. The packer 318 has a substantially cylindrical tubular body 310 having a throughbore 311 and a longitudinal axis 314. The outer surface of the body 310 is stepped at shoulder 310*s* which faces the lower end 310*l* of the body 310. Above the shoulder 310*s* the body 310 has a large diameter portion and below the shoulder the body has a reduced diameter portion adapted to receive the annular components of the packer thereon, which are retained against the shoulder 310*s*. A cylindrical bore 312 extends axially through a sidewall of the body 310 parallel to the throughbore 311.

The sides of the outer surface of the lower portion 310*l* are generally straight and parallel, and the ramps are provided by annular cone components that are assembled onto the lower portion 310*l* to cooperate with slips that engage the casing.

An annular upper slip 400 and cone 402 assembly is first offered to the body 310, followed by a resilient packer element 470, and a lower slip 440 and lower cone 330 assembly. The cones 402 and 330 each have a pair of annular ramps with wedge-shaped cross sections with the tapered ends of the ramps on the respective cones facing away from an annular recess 310*r* that accommodates the resilient packer element 470 between the cones 402, 330. The slips 400, 440 have external serrated gripping ribs with asymmetric profiles that have a shallow face on one side facing the recess, and a steep face on the other side, facing away from the recess. The slips 400, 440 are retained on the exterior of the body 310 by two slip rings 430, and have ramped inner faces that cooperate with the ramps on the external faces of the cones 400, 440 in a similar manner to the earlier embodiments. In this embodiment, the thin ends of the ramps on the inner surfaces of the slips face toward the recess 310*r* and the ramps on the cones 400, 440, in an opposite orientation to the ramps on the earlier embodiments.

A generally cylindrical hollow piston housing 380 extends co-axially with the body 310 and has an inner diameter greater than the outer diameter of the body 310, with an annular chamber 322 housing an annular piston 570. The piston 570 is temporarily attached to the piston housing 380 by a shear screw 540 to retain the piston 570 in the running in position prior to actuation. The piston 570 can optionally also be secured with test pins 541 passing through the piston housing 380 and piston 570 and abutting against the outer surface of the body 310, which restrain the piston during factory testing, but the test pins 541 are removed before deployment in a well, allowing the piston 570 to slide within the annular chamber 322 after the shear screw 540 has sheared.

The piston housing 380 is secured at its lower end to the body 310, typically by means of a lock ring and a screw cap. The upper end of the annular piston 570 is received within a counterbored annular space at the lower end of an annular cone 600 that is slid onto the lower portion of the body 310*l* after the lower cone and slip assembly and before the piston 570 and piston housing 380. The inner surface of the annular space has an internal groove 601, adjacent to the upper end of the annular space, which terminates in a downwardly facing shoulder 602. The lower cone 600 is typically secured to the body 310 by means of shear screws 601 (see FIG. 11*c*).

The piston 570 typically has a locking mechanism to connect it to the cone. The locking mechanism typically takes the form of an external groove 571 on the outer surface of the piston 570, located at its upper end, which is received within the annular space within the lower end of the cone 600. An outwardly biased snap ring 572 is located within the external groove 571, and is typically prevented from expanding radially out of the groove 571 by the inner surface of the cone 600, as best shown in FIG. 13*c*.

The cone 600 transfers axial forces from the piston 570 to the slips 400, 440, and to the resilient packer element 470, and typically has a mechanism controlling the relative movement of the cone 600 and the body 310. In this embodiment, the mechanism is a ratchet mechanism that restricts movement in one direction but allows movement in the other direction. In the ratchet mechanism on this embodiment, a radially segmented cone lock ring 620 is housed within the bore of the cone 600 between the cone 600 and the body 310, and is secured against axial movement relative to the cone 600 by a set screw 602. The cone lock ring 620 has fine gauge ratchet teeth 621 on its inner surface that can engage with an outer thread on the body 310, and coarse ratchet teeth 622 on its outer surface, which engage with coarse gauge teeth on the inner surface of the cone 600. The fine inner teeth 621 restrain relative movement between the cone 600 and the body 310 only when the fine teeth 621 are pressed firmly against the outer thread on the body 310. The lock ring 620 is biased slightly outwardly, against the coarse outer teeth, and so the inner teeth 621 are only loosely engaged with the body 310 when the ring 620 is expanded.

The profile of the coarse outer teeth 622 is asymmetric, and permits the disjointed segments of the lock ring 620 to expand slightly out of engagement with the body 310 when the ring is moving upwards with the cone 600, which allows the cone 600 to move up the outer surface of the body 310 in the direction of the arrow B in FIG. 13*a*. Any forces in the opposite direction, i.e. downward forces, are resolved by the asymmetrical coarse outer teeth to compress the lock ring 620 into engagement with the body 310, preventing downward movement of the cone 600 relative to the body 310.

The tubing throughbore 311 is connected to the annular chamber 322 housing the piston 570 by radial channels 381, which emerge between seals 580 sealing the piston 570 within the annular chamber 322. The control line 312 is connected to the annular chamber 322 housing the piston by channels 313, which emerge in the annular chamber behind (i.e. below the lowermost seal 580. The channels 313 are spaced axially apart from the channels 381, as best seen in FIG. 13*a* and in FIG. 23, which shows the emergence of the tubing channel 381 between the seals 580.

Thus in the sixth embodiment, the piston 570 is configured to push the cone 600 upwards against the slips 440, to activate the slips 400, 440 and the packer element 470, according to the following activation sequence.

Once the tool 318 is situated in the wellbore, increases in pressure within the throughbore 311 of the tubing string will not cause actuation of the tool 318 because the radial channels 381 are substantially obturated by the piston 570 that has seals 580 on either side of the radial channels 381. The seals 580 substantially restrict communication between the pressurised fluid in the throughbore 311 and the annular space surrounding the body 310. The seals 580 are optionally supported within their grooves. As a result, pressure in the throughbore 311 of the tubing string has no effect on the piston 570.

As in previous embodiments, once the setting pressure has been achieved in the tubing, the operator delivers a controlled supply of hydraulic fluid via the control line 312 from surface or a separate downhole source. The fluid pressure within the chamber 322 shears the shear screws 540 attaching the piston 570 to the piston housing 380, moving the piston 570 in an upwards direction (in the direction of arrow B). The piston 570 moves up a short distance under the pressure of the fluid from the control line 312, until the lower O-ring seal 580 moves above the radial channels 381 which will then allow fluid communication between the chamber 322 behind (e.g. below) the piston 570 and the bore 311 of the tubing. As a result, pressurised fluid from the throughbore 311 floods the chamber 322 behind the piston 570 and drives the piston 570 upward in the direction of the arrow B, and into the annular space within the lower portion of the cone 600. The top face of the piston shoulders out on the shoulder 601, transferring the force behind the piston 570 to the cone 600. At the same time, the grooves 601, 571 are aligned, and the snap ring 572 can expand thereby preventing downward movement of the piston 570 relative to the cone 600. Upward movement of the cone 600 pushed by the piston 570 typically shears shear screws 601 attaching the cone 600 to the body 310, and tubing pressure from the throughbore 311 acts upon the piston 570 to drive the cone 600 upward in the direction of the arrow B.

The upper surface of the cone 600 pushes the lower face of the lower slip 440 upward, which compresses the slip and cone assemblies, and compresses the resilient packer element 470 between them, thereby driving the slips up the ramps and compressing the resilient element 470 so that it expands radially. Optionally the slips 400, 440 can be secured to the body 310 by shear screws 403, which prevent premature axial movement of the slips 400, 440. Thus convergent movement of the ramps drives the slips 400, 440 radially outwardly. The retaining rings 430 expand and/or are broken and the external serrated gripping ribs of the slips 400, 440 move radially until the ribs engage with the casing to mechanically secure the tool 318 to the casing. As shown in FIGS. 14 and 15, the tool 318 can be set in a range of different diameters of casing.

The piston lock ring 620 with the asymmetric teeth profile resolves the downward reaction force from the compressed and activated slips radially inwards to clamp the cone 600 more securely against the body 310, so that the activated packer element 470 and the slips 400, 440 remain in the set position even in the event of a reduction in the tubing pressure acting on the piston 570.

According to the above described method for activation of the tool 318, the relatively low pressure from the controlled source supplied via the cylindrical bore 312 is used to trigger actuation of the tool 318. However, the tubing pressure is used to set the tool 318. Both forces act on the same force transmission, i.e. the piston 570 and cone 600, notwithstanding the different sources of the force. The advantage of this activation mechanism is that the tool 318 can be set even when pressure supplied by the control line 312 is insufficient to fully actuate or set the tool 318. Additionally, the embodiment has the advantage that the slips 400, 440 and the packing element 570 are set using tubing pressure, which, as previously acknowledged, is generally more reliable and instantaneous than other tools set using control line pressure alone. Furthermore, the fact that the tubing pressure is not constantly acting on the internal actuation mechanism of the tool 318 has the advantage that fluctuations in tubing pressure prior to actuation will have no effect on the tool 318 until the operator desires that the tool 318 is ready to be set and thereby triggers the process using control line fluid pressure via the control line 312.

Various combinations of the described embodiments can also be made.

Although all embodiments describe the use of the activation mechanism with the trigger and actuation steps used to set slips and packing elements, it should be appreciated that the general concept and method of the invention can be used with any pressure actuable downhole tool.

Other applications where the wider concept of the invention can be applied include: packers; inflatable elements; gripping tools; valves; sliding sleeves; and other flow control devices.

Modifications and improvements can be made without departing from the scope of the invention.

The invention claimed is:

1. A pressure actuable downhole tool comprising:

an actuator piston sealed in a chamber and axially movable in the chamber to actuate the pressure actuable downhole tool on exposure of the actuator piston to a predetermined pressure;

a communication line extending from a throughbore to an opening in the chamber to transmit a downhole fluid pressure to the actuator piston;

a trigger piston moveable between a first configuration in which the communication line is substantially fluidly isolated from the chamber and the actuator piston and a second configuration which permits fluid communication along the communication line to activate the actuator piston; and a control line radially spaced form the throughbore, the control line having an opening to the chamber to selectively deliver pressurized driving fluid into the chamber to drive the actuator piston.

2. The pressure actuable downhole tool of claim 1, wherein the trigger piston is selectively actuable to selectively move the actuator piston in order to actuate the pressure actuable downhole tool.

3. The pressure actuable downhole tool of claim 1, wherein at least part of the pressure actuable downhole tool comprises seals to substantially fluidly isolate the communication line in the first configuration.

4. The pressure actuable downhole tool of claim 1, wherein the actuator piston has at least two seal assemblies, axially spaced from one another along the actuator piston to seal the actuator piston within the chamber, and wherein the seal assemblies are located on either side of the communication line within the chamber to substantially fluidly isolate the communication line.

5. The pressure actuable downhole tool of claim 4, wherein the trigger piston is selectively actuable to move the actuator piston from the first to the second configuration by moving the actuator piston by a predetermined length such that both of the seal assemblies locate on one side of the communication line.

6. The pressure actuable downhole tool of claim 1, wherein the opening of the control line within the chamber is axially spaced from the opening of the communication line in the chamber.

7. The pressure actuable downhole tool of claim 1, wherein the trigger piston and the actuator piston are both sealed in the same chamber, and wherein the trigger piston is located in the chamber between the opening of the control line in the chamber and the opening of the communication line in the chamber.

8. The pressure actuable downhole tool of claim 7, comprising a trigger piston stop to restrain movement of the trigger piston within an area of the chamber defined between the opening of the communication line in the chamber and the opening of the control line in the chamber.

9. The pressure actuable downhole tool of claim 7, wherein the trigger piston is movable in response to the supply of hydraulic fluid through the opening of the control line in the chamber.

10. The pressure actuable downhole tool of claim 1, wherein the trigger piston is spaced axially from the actuator piston.

11. The pressure actuable downhole tool of claim 1, wherein respective positions of the actuator piston in the first and second configurations are spaced apart from one another, and the actuator piston is moved axially for a distance between the retrospective positions before actuating the pressure actuable downhole tool in the second configuration.

12. The pressure actuable downhole tool of claim 1, wherein the pressure actuable downhole tool is selected from the group consisting of:

packers;
inflatable elements;
gripping tools;
slips;
valves;
sliding sleeves; and
other flow control devices.

13. The pressure actuable downhole tool of claim 1, wherein the actuator piston has a locking mechanism to restrict movement of the actuator piston in the second configuration.

14. The pressure actuable downhole tool of claim 1 comprising, wherein the pressure actuable downhole tool has a locking mechanism to restrict movement from the second configuration to the first configuration.

15. A method of actuating a pressure actuable downhole tool having a throughbore, the method comprises:

(a) providing a pressure responsive actuator piston sealed in a chamber, wherein the pressure responsive actuator piston is arranged to move axially in the chamber, providing a communication line communicating downhole pressure to the pressure responsive actuator piston, wherein the communication line extends from the throughbore to the chamber transmitting fluid pressure from the throughbore to the chamber, and providing a trigger piston moveable between a first configuration in which the communication line is substantially fluidly isolated and a second configuration which permits fluid communication along the communication line to activate the pressure responsive actuator piston;

(b) substantially fluidly isolating the communication line in the first configuration;

(c) running the downhole tool;

(d) actuating the trigger piston to selectively deliver a supply of pressurized driving fluid into the chamber through a control line to move the pressure responsive actuator piston within the chamber, and thereby move the trigger piston, and thereby allowing downhole fluid pressure to activate the pressure responsive actuator piston via the communication line, wherein the control line is spaced from the throughbore; and (e) actuating the downhole tool.

16. The method of claim 15, wherein the method includes:

increasing fluid pressure within the throughbore; and using the increased the downhole fluid pressure from the throughbore to actuate the downhole tool via the communication line.

17. The method of claim 15, wherein the method includes:

supplying pressure through the control line to move the trigger piston against the pressure responsive actuator piston.

* * * * *

UNITED STATES PATENT AND TRADEMARK OFFICE

CERTIFICATE OF CORRECTION

PATENT NO. : 8,567,510 B2
APPLICATION NO. : 12/811108
DATED : October 29, 2013
INVENTOR(S) : Stewart Christie et al.

It is certified that error appears in the above-identified patent and that said Letters Patent is hereby corrected as shown below:

In the Claims

Column 12, Claim number 11, Line number 44
Replace "retrospective"
With -- respective --

Column 12, Claim number 14, Line numbers 60-61
Replace "comprising, wherein the pressure actuatable downhole tool has"
With -- , further comprising --

Column 12, Claim number 15, Line number 65
Replace "comprises"
With -- comprising --

Signed and Sealed this
Twentieth Day of May, 2014

Michelle K. Lee

Michelle K. Lee
*Deputy Director of the United States Patent and Trademark Office*